US008371817B2

(12) United States Patent
Mukira et al.

(10) Patent No.: US 8,371,817 B2
(45) Date of Patent: Feb. 12, 2013

(54) APPARATUS AND METHOD FOR A TURBINE BUCKET TIP CAP

(75) Inventors: Gitahi Charles Mukira, Simpsonville, SC (US); Daniel Anthony Nowak, Greenville, SC (US); Michael Douglas Arnett, Simpsonville, SC (US); Srikanth Chandrudu Kottilingam, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 783 days.

(21) Appl. No.: 12/559,656

(22) Filed: Sep. 15, 2009

(65) Prior Publication Data

US 2011/0064584 A1 Mar. 17, 2011

(51) Int. Cl.
*B64C 11/20* (2006.01)
*B64C 11/26* (2006.01)

(52) U.S. Cl. ..... 416/213 R; 416/233; 29/889.21

(58) Field of Classification Search ..... 416/174, 416/228, 224, 223, 213 R, 92, 90 R
See application file for complete search history.

(56) References Cited

U.S. PATENT DOCUMENTS

| | | | | |
|---|---|---|---|---|
| 4,411,597 | A * | 10/1983 | Koffel et al. | 416/92 |
| 4,761,116 | A * | 8/1988 | Braddy et al. | 416/92 |
| 5,232,343 | A | 8/1993 | Butts | |
| 5,622,638 | A * | 4/1997 | Schell et al. | 219/121.64 |
| 6,761,535 | B1 | 7/2004 | McGrath et al. | |
| 7,001,151 | B2 | 2/2006 | Wang et al. | |
| 7,097,419 | B2 * | 8/2006 | Lee et al. | 415/115 |
| 7,168,921 | B2 | 1/2007 | Honkomp et al. | |
| 2003/0143074 | A1 * | 7/2003 | Tsukamoto et al. | 416/96 R |
| 2006/0067830 | A1 * | 3/2006 | Guo et al. | 416/229 R |
| 2006/0285974 | A1 | 12/2006 | Bunker et al. | |
| 2007/0017906 | A1 | 1/2007 | Nowak et al. | |
| 2007/0077143 | A1 | 4/2007 | Sherlock et al. | |
| 2009/0049689 | A1 * | 2/2009 | Hiskes | 29/889.1 |
| 2009/0155088 | A1 * | 6/2009 | Lee et al. | 416/90 R |

OTHER PUBLICATIONS

Special Metals, Inconel alloy 718, Sep. 2007, pp. 1-2.*
Special Metals, Inconel alloy 625, Jan. 2006, pp. 1 and 14.*
Special Metals, Inconel alloy 617, Mar. 2005, p. 1.*
Haynes International, Haynes 230 Alloy Tech Brief, Jan. 2003, p. 1.*

* cited by examiner

*Primary Examiner* — Edward Look
*Assistant Examiner* — William Grigos
(74) *Attorney, Agent, or Firm* — Dority & Manning, P.A.

(57) ABSTRACT

A turbine bucket that includes a pressure side, a suction side opposite the pressure side, and a rib extending between the pressure side and the suction side. A tip cap is attached to the pressure side and the suction side and covers the rib. The tip cap includes a precipitation hardened material and a passage aligned with the rib. A method for assembling a turbine bucket having a pressure side and a suction side and a rib extending between the pressure side and suction side. The method includes receiving a tip cap made from a precipitation hardened material and having a passage in the tip cap. The method further includes locating the rib visually through the passage and aligning the passage with the rib. The method also includes welding the tip cap to the turbine bucket and to the rib.

14 Claims, 3 Drawing Sheets

APPARATUS AND METHOD FOR A TURBINE BUCKET TIP CAP

FIELD OF THE INVENTION

The present invention generally involves the design and assembly of a tip cap for a turbine bucket.

BACKGROUND OF THE INVENTION

Gas turbines are widely used in commercial operations for power generation. A typical gas turbine includes a compressor at the front, one or more combustors around the middle, and a turbine at the rear. The compressor and the turbine typically share a common rotor.

The compressor includes multiple stages of compressor blades attached to the rotor. Ambient air enters an inlet of the compressor, and rotation of the compressor blades imparts kinetic energy to the working fluid (air) to bring it to a highly energized state. The compressed working fluid exits the compressor and flows to the combustors where it mixes with fuel in the combustors. The mixture of the compressed working fluid and fuel ignites in the combustors to generate combustion gases having a high temperature, pressure, and velocity. The combustion gases exit the combustors and flow to the turbine where they expand to produce work.

The turbine includes alternating rows of rotating turbine blades or turbine buckets and stationary nozzles or stators enclosed in a casing. As the combustion gases from the combustors pass over the turbine buckets, the combustion gases expand, causing the turbine buckets to rotate. The combustion gases then flow to the stators which redirect the combustion gases to the next row of rotating turbine buckets, and the process repeats for the following stages.

The thermodynamic efficiency of the gas turbine may be increased by operating the gas turbine at higher temperatures. For example, higher temperature combustion gases contain more energy which produce more work as the combustion gases expand across the turbine buckets. Increased temperatures, however, have a detrimental affect on the strength of the turbine components. For example, nickel or cobalt alloys, such as Inconel 617, Haynes 188, and Haynes 230, are commonly used in turbine buckets because of their ductility, ease in welding, and long fatigue life. However, the strength of these nickel and cobalt alloys decreases as the temperature increases. The reduced strength at higher temperatures produces swelling or creep in the turbine components, particularly at the tip of the turbine buckets, which may result in an unacceptable clearance between the rotating turbine buckets and the casing. As a result, turbine buckets made from nickel or cobalt alloys typically require reduced combustion temperatures, additional cooling systems to limit the maximum temperature of the turbine buckets, and/or increased maintenance and inspection cycles.

A variety of techniques are used to allow turbines to operate with higher temperature combustion gases. For example, working fluid may be extracted from the compressor and supplied to the turbine to cool the higher temperature stages in the turbine. However, the use of working fluid to cool the turbine reduces the overall thermodynamic efficiency of the gas turbine. Additional manufacturing techniques, such as directional solidification and improved heat treatments, may be utilized to manufacture turbine components to allow the turbine to operate at higher temperatures. These additional manufacturing techniques, however, increase the time and cost to manufacture the turbine components.

Another technique to allow turbines to operate at higher temperatures is to incorporate new materials, specifically precipitation hardened superalloys into the design of the turbine components. These superalloys have improved strength at higher temperatures, reducing the onset of swelling or creep at operating temperatures during the life of the components. However, the high strength precipitation hardened alloys have lower ductility and are in general difficult to weld.

Therefore, the need exists for improved turbine components that can operate at increasingly higher temperatures. In addition, the need exists for improved manufacturing methods that may improve the integrity of weld joints between the turbine components.

BRIEF DESCRIPTION OF THE INVENTION

Aspects and advantages of the invention are set forth below in the following description, or may be obvious from the description, or may be learned through practice of the invention.

One embodiment of the present invention is a turbine bucket that includes a pressure side, a suction side opposite the pressure side, and a rib extending between the pressure side and the vacuum side. A tip cap is attached to the pressure side and the vacuum side and covers the rib. The tip cap includes a precipitation hardened material and one or more passages aligned with the rib.

An alternate embodiment of the present invention is a method for assembling a turbine bucket having a pressure side and a suction side and a rib extending between the pressure side and suction side. The method includes receiving a tip cap made from a precipitation hardened material and having one or more passages in the tip cap. The method further includes locating the rib visually through the one or more passages and aligning the one or more passages with the rib. The method also includes welding the tip cap to the turbine bucket and to the rib.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION

Figure 1:
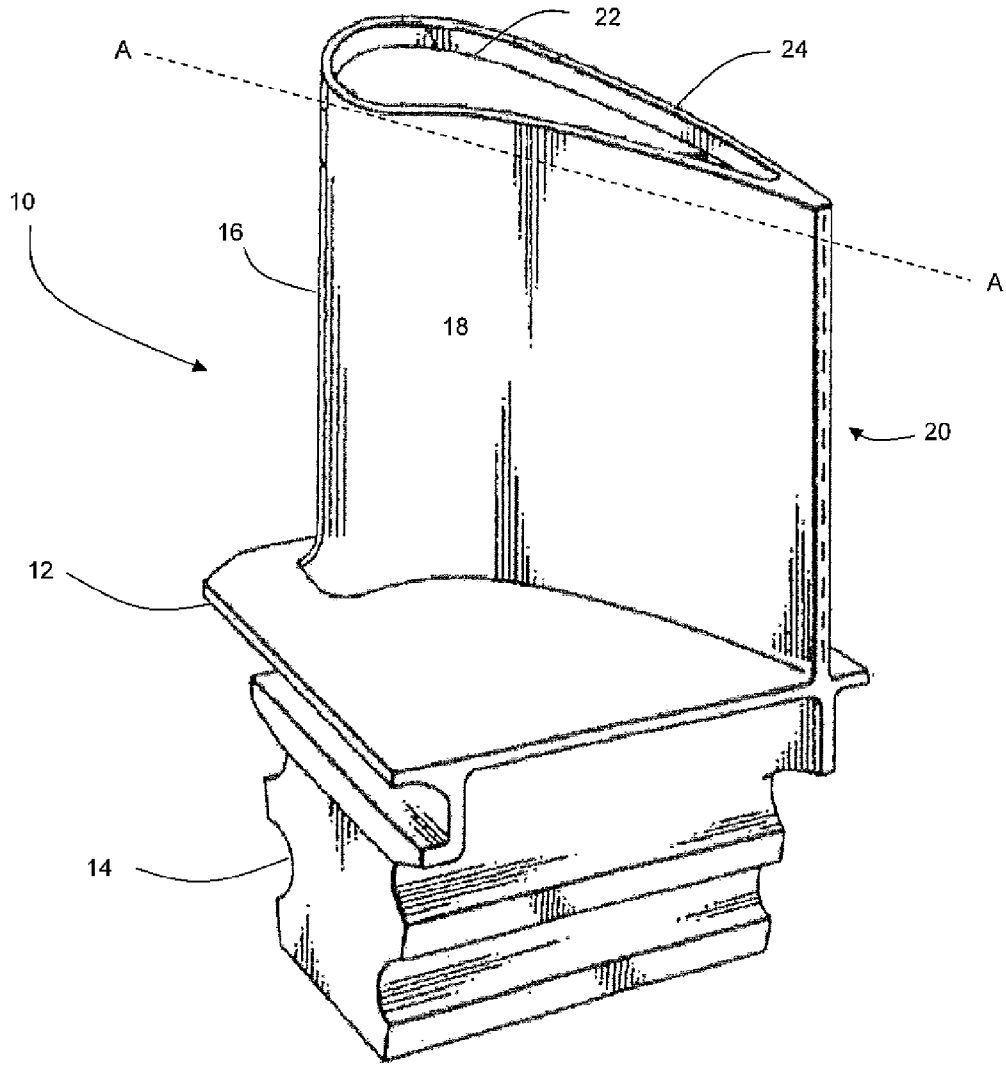
FIG. 1 is a perspective view of a turbine blade or turbine bucket within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof For instance, features illustrated or described as part of one embodiment may be used on another embodiment to yield a still further embodiment. Thus, it is intended that the present invention covers such modifications and variations as come within the scope of the appended claims and their equivalents.

FIG. 1 shows a perspective view of a turbine blade or turbine bucket 10 within the scope of the present invention. The turbine bucket 10 has a platform 12 which attaches to the rotor (not shown) through a suitable connection, such as a dovetail 14 configuration as shown in FIG. 1. The external surface of the turbine bucket 10 has an airfoil 16 shape, with a pressure side 18 and a suction side 20, to facilitate the flow of combustion gases over the surface. The turbine bucket 10 is typically hollow to allow for the internal flow of cooling air within the turbine bucket 10 to reduce the surface temperature of the turbine bucket 10. The turbine bucket 10 is typically cast using precipitation hardened superalloys such as Rene N5, GTD-111, and other superalloys.

A tip cap 22 attaches to the top of the turbine bucket 10 to provide a closed volume within the turbine bucket 10 to contain the cooling air. The tip cap 22 is made from a precipitation hardened material. The precipitation hardened material includes at least approximately 15% by volume of precipitant and preferably more than 20% by volume of precipitant. Examples of precipitation hardened materials within the scope of the present invention include, but are not limited to, high gamma prime nickel base materials, Rene N5, Rene N4, Rene 142, GTD-111, GTD-222, and Inconel 738. The precipitation hardened material provides increased strength over the operating temperatures of the turbine compared to solid solution strengthened materials. As a result, the tip cap 22 is less susceptible to swelling and creep, thereby potentially increasing the intervals between maintenance and inspection cycles.

As shown in FIG. 1, the top of the turbine bucket 10 may include a recess 24 in which the tip cap 22 fits. The tip cap 22 provides additional support between the pressure 19 and suction 20 sides of the turbine bucket 10 to maintain the shape of the airfoil 16. In addition, the recessed tip cap 22 provides additional clearance between the turbine bucket 10 and surrounding casing (not shown).

Figure 2:
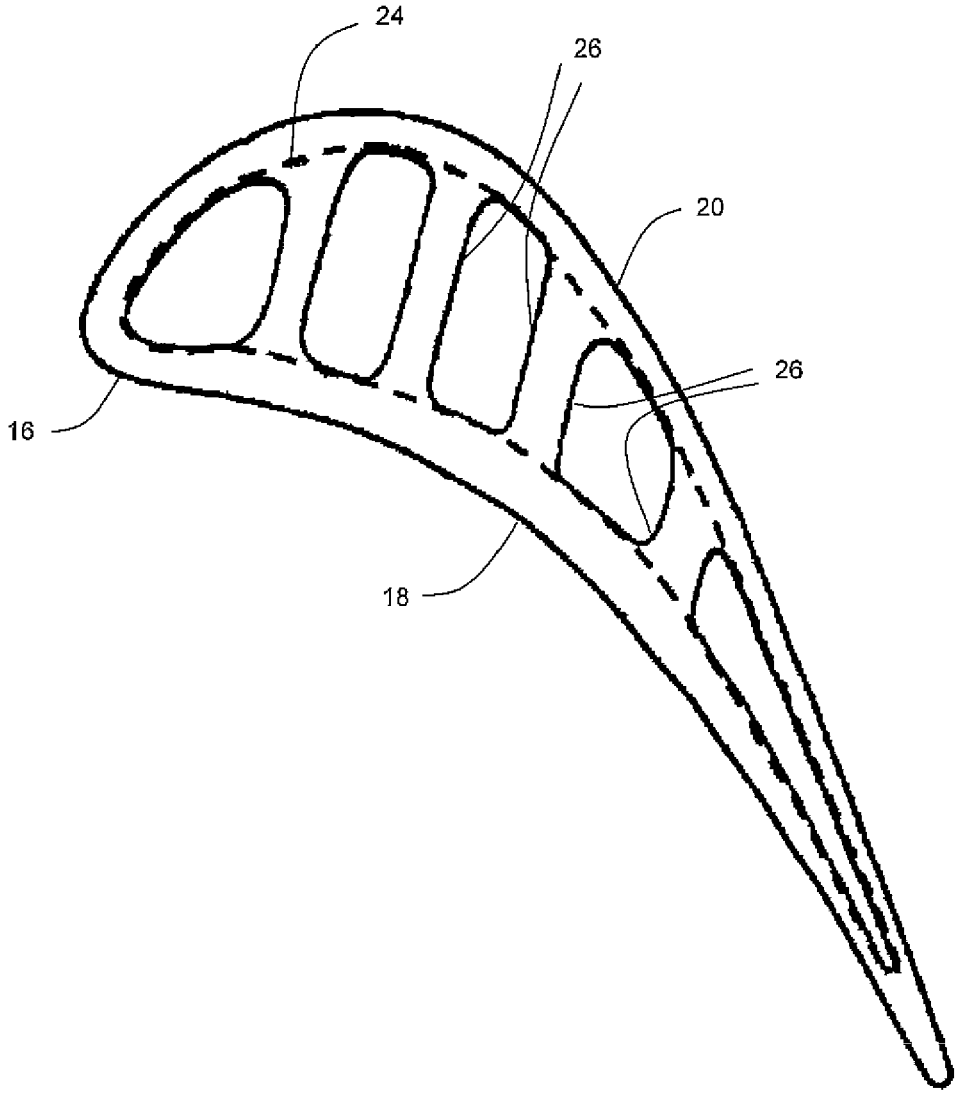
FIG. 2 is a simplified cross-section of the turbine bucket shown in FIG. 1 along line A-A.

FIG. 2 provides a simplified cross-section of the turbine bucket 10 shown in FIG. 1 along line A-A. The dashed line inside the perimeter of the turbine bucket 10 represents the recess 24 in which the tip cap 22 fits. As shown in FIG. 2, the interior of the turbine bucket 10 includes one or more ribs 26 extending between the pressure side 18 and suction side 20 of the airfoil 16. The ribs 26 provide additional support between the pressure 18 and suction 20 sides of the turbine bucket 10 and may extend downward within the turbine bucket 10 to form passages through which the cooling air flows.

Figure 3:
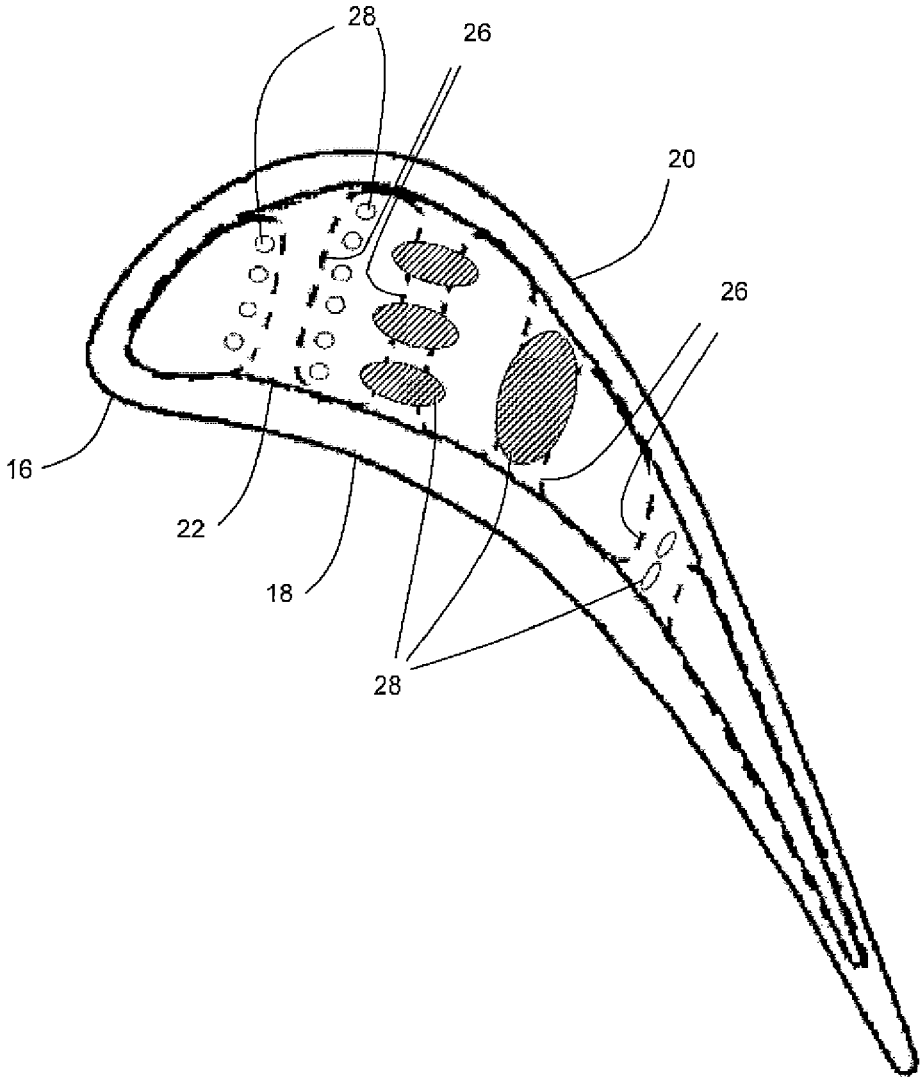
FIG. 3 is a top plan view of a turbine bucket according to one embodiment of the present invention.

FIG. 3 provides a top plan view of the turbine bucket 10 according to one embodiment of the present invention. In this view, the solid line around the inside perimeter of the turbine bucket 10 represents the tip cap 22, and the dashed lines represent the ribs 26 beneath the tip cap 22. As shown in FIG. 3, the tip cap 22 includes one or more passages 28 through the tip cap 22. The passages 28 are located to approximately coincide with the location of the underlying ribs 26, meaning that the passages 28 may be adjacent to, alongside, or directly above the ribs 26. The passages 28 may be slots or holes in the tip cap 22 that may take any of several shapes and sizes, as shown in FIG. 3. For example, the passages 28 may be smaller or larger than the adjacent or underlying ribs 26.

The precipitation hardened tip cap 22 may be attached to the inside perimeter of the turbine bucket 10 and/or one or more of the ribs 26 using electron beam, laser, or arc welding techniques known in the art. If desired, the tip cap 22 and the ribs 26 may be preheated at a temperature between 500 degrees Fahrenheit and 1,800 degrees Fahrenheit before welding the tip cap 22 to the ribs 26.

The passages 28 allow the tip cap 22 to be accurately positioned with respect to the underlying ribs 26 prior to welding, thereby reducing the possibility that the weld holding the precipitation hardened tip cap 22 may fail at higher operating temperatures. For example, the ribs 26 may be visually observed through the passages 28 prior to welding. In alternate embodiments, a camera may photograph the top of the tip cap 22, and the photograph may be electronically processed to determine the precise location of the ribs 26 through the passages 28. Regardless of the method used, the tip cap 22 may be precisely fitted in the recess 24 using one or more shims, if necessary, based on the precise location of the underlying ribs 26. In addition, the precise location of the ribs 26 can be determined or verified prior to welding to ensure accurate positioning of the welding beam, thereby avoiding a blind seam weld that would be required in the absence of the passages 28.

If desired, filler material, illustrated as cross-hatching inside some of the passages 28 in FIG. 3, may be inserted through the passages 28 for use in the weld between the tip cap 22 and the ribs 26. Suitable filler material within the scope of the present invention includes Inconel 617, Inconel 625, and Haynes 230. The ductile filler material improves the weldability of the weld joint created between the tip cap 22 and the ribs 26.

It should be appreciated by those skilled in the art that modifications and variations can be made to the embodiments of the invention set forth herein without departing from the scope and spirit of the invention as set forth in the appended claims and their equivalents.

What is claimed is:

1. A turbine bucket, comprising:

a. a pressure side;

b. a suction side opposite the pressure side;

c. a rib extending between the pressure side and the suction side, wherein the rib has a first side and a second side;

d. a tip cap attached to the pressure side and the suction side and covering the rib, wherein the tip cap comprises:

i. a precipitation hardened material;

ii. a plurality of passages aligned with the rib, wherein a first passage of the plurality of passages is adjacent to the first side of the rib and a second passage of the plurality of passages is adjacent to the second side of the rib; and iii. a filler material in the plurality of passages.

2. The turbine bucket of claim 1, wherein the tip cap comprises a high gamma prime nickel base superalloy.

3. The turbine bucket of claim 1, wherein the tip cap comprises at least 20% by volume of precipitation hardened precipitant.

4. The turbine bucket of claim 1, wherein the plurality of passages are wider than the rib.

5. The turbine bucket of claim 1, wherein the plurality passages are narrower than the rib.

6. The turbine bucket of claim 1, further including the filler material between the tip cap and the rib.

7. The turbine bucket of claim 1, wherein the filler material is selected from the group consisting of Inconel 617, Inconel 625, and H 230.

8. A method for assembling a turbine bucket having a pressure side and a suction side and a rib extending between the pressure side and suction side, the method comprising:

a. receiving a tip cap made from a precipitation hardened material and having a plurality of passages in the tip cap;

b. locating the rib through the plurality of passages;

c. aligning a first passage of the plurality of passages adjacent to a first side of the rib;

d. aligning a second passage of the plurality of passages adjacent to a second side of the rib;

e. welding the tip cap to the turbine bucket; and f. welding the tip cap to the rib.

9. The method of claim 8, further including visually locating the rib through the plurality of passages.

10. The method of claim 8, further including electronically locating the rib through the plurality of passages.

11. The method of claim 8, further including inserting a filler material through the plurality of passages.

12. The method of claim 8, further including electron beam welding the tip cap to the rib.

13. The method of claim 8, further including laser beam welding the tip cap to the rib.

14. The method of claim 8, further including preheating the tip cap and the rib at a temperature between 500 degrees Fahrenheit and 1,800 degrees Fahrenheit before welding the tip cap to the rib.

* * * * *

UNITED STATES PATENT AND TRADEMARK OFFICE

CERTIFICATE OF CORRECTION

PATENT NO. : 8,371,817 B2
APPLICATION NO. : 12/559656
DATED : February 12, 2013
INVENTOR(S) : Mukira et al.

It is certified that error appears in the above-identified patent and that said Letters Patent is hereby corrected as shown below:

In the Specifications:

In Column 3, Line 1, delete "thereof" and insert -- thereof. --, therefor.

In Column 3, Line 38, delete "19" and insert -- 18 --, therefor.

Signed and Sealed this
Twenty-fifth Day of June, 2013

Teresa Stanek Rea
*Acting Director of the United States Patent and Trademark Office*